United States Patent [19]

Suzuki et al.

[11] 4,206,249

[45] Jun. 3, 1980

[54] PROCESS FOR PRODUCING A PAPER CONTAINER HAVING HIGH IMPERMEABILITY TO LIQUID

[75] Inventors: Shoichi Suzuki, Tokyo; Hisao Okada, Funabashi, both of Japan

[73] Assignees: Nihon Dixie Company Limited, Tokyo; Toa Paint Co., Ltd., Osaka, both of Japan

[21] Appl. No.: 34,684

[22] Filed: Apr. 30, 1979

Related U.S. Application Data

[63] Continuation-in-part of Ser. No. 938,355, Aug. 31, 1978, abandoned.

[30] Foreign Application Priority Data

Sep. 6, 1977 [JP] Japan ..... 52-107091

[51] Int. Cl.[2] ..... B05D 3/06

[52] U.S. Cl. ..... 427/54.1; 229/3.1; 427/422

[58] Field of Search ..... 427/54, 44, 395, 422; 229/3.1

[56] References Cited

U.S. PATENT DOCUMENTS

| | | | |
|---|---|---|---|
| 2,708,544 | 5/1955 | Norman | 229/3.1 |
| 3,979,270 | 9/1976 | Trecker et al. | 204/159.14 |
| 4,070,500 | 1/1978 | Leitner et al. | 427/54 |
| 4,097,350 | 6/1978 | Pastor et al. | 427/54 |
| 4,150,169 | 4/1979 | Bagley et al. | 427/54 |

*Primary Examiner*—John H. Newsome

*Attorney, Agent, or Firm*—Frishauf, Holtz, Goodman & Woodward

[57] ABSTRACT

A process for producing a paper container having high impermeability to liquid comprising spray coating a polymerizable solution containing a prepolymer, photosensitizer and/or reactive diluent onto a wall surface of previously fabricated paper containers, allowing the prepolymer and/or reactive diluent to polymerize by an ultraviolet irradiation to thereby form a liquid impermeable coating on the wall surface of the container.

4 Claims, No Drawings

PROCESS FOR PRODUCING A PAPER CONTAINER HAVING HIGH IMPERMEABILITY TO LIQUID

CROSS-REFERENCE TO RELATED APPLICATION

The present application is a continuation-in-part of U.S. Application Serial No. 938,355, filed on August 31, 1978, and now abandoned.

BACKGROUND OF THE INVENTION

The present invention relates to a process for producing coated paper containers having high impermeability to liquid. More particularly, the present invention relates to a process for producing paper containers having high impermeability to liquid which comprises spray coating a polymerizable solution containing a prepolymer onto a wall surface of, for example, a paper container, irradiating the coated wall of the container with ultraviolet light from all directions to effect the setting of said prepolymer on the wall surface of the container, thus forming a coating which is impermeable to liquids, such as water, milk, softdrinks, oils, etc.

Handy paper containers have hitherto been used for temporarily storing liquids such as water. Such containers, however, generally have a disadvantage in that the liquid gradually penetrates the paper constituting the container to render the paper wet; this decreases the mechanical strength of the container and sometimes leads to leakage of the liquid contents through the wall of the container. Therefore, it has been a practice to treat the wall surface of the container so as to prevent the penetration of the liquid contents into the paper constituting the container. The wax coating is one example of such treatments. In this method, wax is coated on the surface of the container by spraying a melted wax onto the wall surface of the container by a spray gun or the like or by dipping the container in melted wax and draining off the excess wax and allowing the deposited wax to solidify on cooling to give a water resistant container. However, this method suffers from several disadvantages. For example, it is very difficult to uniformly coat the wax over the wall surface of the container. Also, wax is expensive, so use of wax raises the cost of the product. Further, a wax coating is not applicable to containers for storing oily liquids, which have affinity for the coated wax, i.e., the wax will be dissolved in the oil and as a result the oil will be stained. Therefore, the use of wax coated containers is usually limited to products having no affinity for wax such as water, aqueous solutions, etc. Furthermore, when wax coated containers are bent at a low temperature, the wax on the wall surface cracks or comes off upon contact with cutlery or other edged or pointed metalware. In addition, although wax-coated water proof containers can be used to hold a liquid at a relatively low temperature, they are not suitable for holding hot (e.g. 50°-100° C.) products, because the wax softens and melts. A further disadvantage is that wax must be melted at a high temperature and the wax vapor produced by melting the wax spreads throughout the workshop and may be injurious to the operators' health.

Besides the wax coating method, another treating method has been practiced. In this method, a paper stock from which such containers are to be fabricated is provided on one or both sides thereof with a film of thermoplastic material such as polyethylene. Container components i.e. container body blanks and bottom panels or walls having a predetermined shape are then subsequently cut from the sheet material and formed into, for example, cup-shaped, containers having a coating of plastic film on the wall surface by a conventional method. However, this method also has inherent drawbacks. One disadvantages is that when body blanks are formed about a round mandrel with a plastic film coating on, for example, the inside so as to bring opposite cut ends of the blank into slight overlapping relationship so as to form an adhesively bonded side seam extending in axial direction along the container side wall, bonding the cut ends with an adhesive is very difficult in axial direction of the container body due to the presence of the coated plastic film on either of the cut ends. Another disadvantage is that the inner edge forming the side seam is inherently an uncoated edge, so if it is left uncoated, the liquid contents of the container will gradually penetrate through the uncoated or raw edge into the paper, thus leading to swelling and weakening of the paper and decrease in strength of the container. Still another disadvantage is that if a bottom seam joining the container body wall and the bottom panel or wall contains voids in the adhesive used to effect the seal it may result in leaking of the contents of the container through the bottom seam. Furthermore, because of the difference in level along the inner edge of the side seam the water filled in the container ascends up to the mouth rim of the container by capillary action and overflows. Therefore, due to the necessity to minimize the area of the raw edge and bottom seam, this method is only applicable at best for the manufacture of generally tapered cylindrical containers and is not suitable for fabricating containers of complicated configuration such as rectangular, hexagonal prisms, etc. Because the containers are fabricated from the paper stock having a plastic coating, there is also a possibility that the plastic film exhibits whitening along the bend at the container mouth rim, bottom edge etc. or the film peals off the paper. The scrap remaining after the body blanks are cut from the sheet can be used for nothing, and must be thrown away, which is an undesirable waste of a valuable petroleum resource, because the scrap is also coated with the plastic film. Still another method being practiced at present is the lining method in which the interior wall surface of the container is lined with a thermoplastic film. In this method, the containers obtained look as if a plastic bag is interposed into the container so as to conform to the side wall and the bottom panel shapes. Thus, there is no fear that the contents of the container will penetrate into the paper and that the contents may leak out through the voids in the bottom seam. However, this method sometimes fails to give uniform thickness at the mouth rim or bottom part of the container. Moreover, since the plastic film lining is only applicable to the interior of the container, it is necessary to use this method in combination with the above mentioned method of forming a container from the blank having the plastic film laminated on the outer surface in order to obtain a container having liquid-impermeable coating on both sides. Yet still, the outer edge forming the side seam extending in an axial direction along the container side wall was an uncoated edge through which, if it were left uncoated, moisture would eventaully penetrate. Such being the case, there has not been presented a process for easily and economically producing paper containers having high liquid impermeability for a wide range of applications. Up to the present there has been no successful attempt to produce a paper container having no uncoated raw edge by a single, simple and speedy method.

SUMMARY OF THE INVENTION

It is an object of the present invention to provide a process for producing paper containers having high liquid impermeability.

Other objects and advantages will become apparent as the description proceeds.

In accordance with the present invention, there is provided a process for producing paper containers having high impermeability to liquid which comprises firstly fabricating a paper container from sheet material having no coating of plastic film on either side using a conventional high speed cup making machine, then spray coating a polymerizable solution containing at least a prepolymer, a photosensitizer and, if necessary, a reactive diluent on the wall surface of the so-fabricated paper container, and then irradiating the coated surface of said container with ultraviolet light from all directions to effect the polymerization of the prepolymer and, when present, the reactive diluent contained in the polymerizable solution, thereby forming a liquid impermeable coating on the wall surface.

DETAILED DESCRIPTION OF THE INVENTION

It is preferred to apply the polymerizable solution both on the inner and outer wall surfaces of the paper container. But, in some embodiments where an appropriate liquid impermeable treatment has previously been applied on the inner wall surface, it is also possible to form in situ a liquid impermeable polymer coating on the outer wall surface by spraying the polymerizable solution thereon. Further, if desired, the polymerizable solution of the present invention may be spray-coated onto the inner wall surface of the container.

The term "inner wall surface" used herein means the entire surface of the interior of the container and the term "outer wall surface" means the entire surface of the exterior of the container.

The containers of the present invention are in general made of paper, but if desired, they may be made of synthetic paper, etc. Also, the containers used in the present invention may be any shape—tapered cylindrical, quadrangular prism, hexagonal prism or cone.

Spray coating of the above mentioned polymerizable solution onto the container wall has to be conducted by hot-melt airless spraying. Conventional air spraying or airless spraying is not suitable for effecting the present invention.

Paper per se is porous and, by nature, has high ability to absorb a liquid. Thus, in applying an ultraviolet light polymerizable solution onto the wall surface of a container, the solution may be absorbed by the paper. However, if the solution to be applied has very high viscosity and the duration from the application of the solution to the end of ultraviolet light activation is within a short period of 5 minutes, the solution is capable of being cured on the surface of the paper before being absorbed. Thus, an attempt was made to inhibit the penetration of the polymerizable solution by the use of highly viscous polymerizable solution. When the shape of materials to be coated is extremely simple such as in the case of a flat panel, the highly viscous solution may be applied thereto by suitable means other than spray coating means, for example, roll coater, gravure coater, bar coater or the like. However, difficulty has been experienced in applying by spray coating means the highly viscous solution to the material to be coated, especially one having a complex shape such as cup, tub, etc.

Irradiation with ultraviolet light has an inherent weak point. That is, ultraviolet light may be hindered by the slightest amount of a barrier (in this case, fibers of paper) so that the curing reactivity will be significantly reduced, and as a result, only the surface layer of the polymerizable solution applied to the paper is cured, producing a state of so-called surface drying and the major part of the polymerizable solution absorbed by the paper remains uncured. In such a case, sufficient film hardness cannot be obtained.

When using air spraying or airless spraying for applying the polymerizable solution to material to be coated, it is necessary to adjust the viscosity of the solution to below 100 centipoises. Such adjustment of the viscosity can be accomplished by the addition of an appropriate diluent to the polymerizable solution. However, when applying the polymerizable solution having a viscosity of less than 100 centipoises to material to be coated by means of air spraying or airless spraying, the solution penetrates or is absorbed by the paper. Thus, in order to avoid this, it is necessary to pretreat the wall surfaces of the paper container to make it impermeable to such a low viscous solution. Therefore, to use the air spraying or airless spraying for applying the polymerizable solution to the wall surfaces of the paper container will be neither practical nor economical.

It has unexpectedly been found that a polymerizable solution having a high viscosity of the order of 20 poises or more can be effectively applied to the wall surfaces of the paper container by using hot-melt airless spraying without pretreating the paper container for inhibiting the penetration of the polymerizable solution into the paper and without adding any diluent to the polymerizable solution for reducing its viscosity.

In general, the maximum viscosity at which the polymerizable solution can be airless-sprayed is about 100 centipoises. Also, in order to inhibit the penetration of the polymerizable solution into the paper, the solution must have a viscosity of at least 20 poises. It has now been found that by using hot-melt airless spraying, the polymerizable solution having a viscosity above 20 poises can be heated to a temperature of up to 120° C., preferably 60°-80° C. for a time to lower the viscosity to the extent that the solution can be airless-sprayed in fine particles for coating. That is, by using hot-melt airless spraying, the polymerizable solution which has a high viscosity at ambient temperature and, therefore, is difficult to satisfactorily atomize at a hydraulic pressure of 100 $Kg/cm^2$ may be converted to a solution having an extremely low viscosity capable of atomizing the solution required for obtaining a smooth surface. Surprisingly, it has been found that the fine particles of the polymerizable solution which has its viscosity lowered by heating are cooled by dissipation of heat into air, so that the viscosity of the polymerizable solution returns to the initial high level when the particles of the solution have reached the paper surface and as a result, the polymerizable solution no longer penetrates into the paper and complete polymerization of the prepolymer in the solution can be conducted on the paper surface by irradiation of ultraviolet light.

Though the temperature to which the polymerizable solution is heated and the viscosity it has at ambient temperature may vary depending on the number and size of the pores in the paper, minimum requirement is that the solution should be heated to a temperature capable of providing a viscosity at which the solution can be airless-sprayed.

The polymerizable solution which may be used in this invention contains at least a prepolymer and a photosensitizer. If necessary, the polymerizable solution can further contain an appropriate reactive diluent.

The prepolymers used in the present invention should be polymerizable by ultraviolet irradiation. Examples of prepolymers which can be used in the present invention include, but are not limited to, unsaturated polyester obtained by reacting unsaturated dicarboxylic acids and glycols, acrylic resins, alkyd resins, epoxyacrylic resins, urethane acrylic resins, etc., which have incorporated unsaturated bonds. These prepolymers are used alone or as a mixture of two or more resins.

Any reactive diluents which are polymerizable together with the above mentioned photosetting prepolymer may be used. Examples of such diluents include styrene, divinyl benzene, vinyl acetate, methyl methacrylate, butyl methacrylate, cyclohexyl methacrylate, methoxy butyl methacrylate, trimethylolpropane trimethacrylate, diester compounds of unsaturated polycarboxylic acids, etc., and they can be used alone or as a mixture thereof. Examples of photosensitizers which may be used in the practice of the present invention include benzoin, benzoin methyl ether, benzoin ethyl ether, benzoin isopropyl ether, benzoin phenyl ether, benzophenone, diazoaminobenzene, diphenyldisulfide, benzylanthraquinonenaphthoquinone, peroxides, metal complexes, azocompounds such as azobisisobutyronitrile, and the like. Photosensitizers other than those mentioned above can also be employed. In spray coating by hot melt airless spray, it is generally preferred to employ a polymerizable solution containing about 0.05–5 parts by weight of a photosensitizer based on 100 parts by weight of a prepolymer and substantially no reactive diluents.

The amount of polymerizable solution to be spray-coated on the wall surface of the container varies depending on the desired thickness of the polymer film formed after the polymerization. In general, however, said polymerizable solution is applied at a rate of about 5–100 g of the solution per square meters of the wall surface of the container. Thus, a polymer film having a thickness of between 5–100$\mu$ is finally formed on the wall surface of the container.

The ultraviolet irradiation from all directions of the wall surface of the container to be coated can be conducted by allowing the container to stand inside an ultraviolet irradiation oven equipped with an ultraviolet source for a short time or passing the container through an ultraviolet irradiation tunnel in a predetermined period of time. As the ultraviolet source, such lamps as a ultra high voltage mercury-arc lamp, high voltage mercury-arc lamp, low voltage mercury-arc lamp, metal halide lamp, xenon lamp, etc. can be employed.

According to the present invention, the polymerization is initiated by ultraviolet irradiation to form a polymer film on the wall surface of the container. As this polymer film is always to function as a liquid impermeable film, the polymer formed must be insoluble in the liquid in the container. The polymer has a three dimensional network structure in which the polymer and the reactive diluent, if present, have been polymerized and crosslinked.

According to the present invention, it is possible to form a smooth liquid impermeable polymer film on the inner and outer wall surfaces of a container, which may sometimes be of a relatively complicated shape, thus yielding a coated container having excellent liquid impermeability. One advantage of the present invention is its ability to cover the entire visual surfaces of the paper container with the water impermeable polymer film after forming a container of complicated shape. In treatment to impart liquid impermeability to the outer wall surface of a container, it is especially difficult by the conventional methods to cover the outer edge forming the side seam extending in an axial direction along the container side wall with an appropriate liquid resistant material, so that this part sometimes remains uncoated, thus impairing the liquid impermeability of the container. In accordance with the present invention, however, a container, even of a relatively complicated shape, can be covered with a polymer film having liquid impermeability on the outer wall surface without leaving any uncoated part or portion, even after the container is fabricated from the sheet material. Therefore, the present invention is suitable for manufacturing paper containers having high liquid impermeability by, for example, applying this process of the present invention to the outer wall surface of the container the inner wall surface of which has been lined with a thermoplastic film by a conventional method.

As the process of the present invention requires only a short time (just a few minutes or less) to obtain a finished product by forming a polymer film on the wall surface by spray coating a polymerizable solution and subsequently irradiating the coating with ultraviolet light, the efficiency of container production is increased, resulting in lower production costs. Although there are several polymerization methods other than by ultraviolet irradiation, such as by heating, i.e., thermal polymerization and by irradiation of radioactive ray such as $\gamma$-ray, i.e. radiation-induced polymerization, these methods are not suitable. Thermal polymerization takes a relatively long time to form a polymer film and moreover there is risk of fire by ignition of paper containers due to overheating. Although radioactive rays have the advantage of rapid polymerization, control of $\gamma$-ray source and irradiation equipment inevitably causes numerous problems and a large sum of money is required, thus making this method infeasible because of its cost and complexity. In contrast, with the use of ultraviolet light as in the present invention, liquid impermeable containers can be easily and economically formed without impairing the container material.

Anyway, the conventional technique occasionally leaves an uncoated raw edge on the inner and/or outer wall surface and, therefore, does not provide containers having perfect liquid impermeability, whereas the present invention has overcome the disadvantages inherent in the conventional methods and provides containers having high liquid impermeability, unobtainable by the conventional methods, at low cost in an easy and rapid manner.

Since the containers, particularly the outer wall surface, produced according to the process of the present invention have high liquid impermeability, these containers can be used for long term storage of, for example, food, by packing, sealing and keeping them in freezers, etc. When the conventional containers are used for long term storage in freezers, water or moisture gradually penetrates through the outer uncoated raw edge forming the side seam of the container, and weakens the container, which sometimes leads to undesirable situations; such trouble can be obviated by use of containers produced according to the present invention. Therefore, the containers produced according to the present invention have a variety of applications. As mentioned above, containers having a liquid impermeable polymer film on the outer wall surface can be used as storage containers for frozen food. The liquid materials to be put in the containers may be either an aqueous liquid or an oily liquid such as animal or vegetable oil as well as organic solvents or other liquid chemicals. In addition to aqueous liquids such as soft drinks, such oil as salad oil can be packed in the containers. The contents are not limited to those mentioned above, i.e., liquids, and water-containing and oil-containing, solid and semi-solid materials can be packed for storage. For example, these containers can be used for packing cooked solid food, butter, cheese, margarine, technical grade grease etc.

The present invention is described in detail in the following examples which are intended as illustrative only and should not be construed as limiting the scope of the invention.

EXAMPLE 1

Paper containers were fabricated from sheet material using a conventional high-speed cup making machine. On the outer wall surface of each container was sprayed a polymerizable solution containing an unsaturated polyester resin and 0.2% by weight of benzoin methyl ether as a pnotosensitizer at a rate of 20 g of the solution per square meters of the container. The spray coating was conducted by heating the above polymerizable solution to 80° C. using a hot melt airless spray device manufactured and sold by Nordson Corporation in the U.S.A. The paper containers thus coated with the polymerizable solution were immediately passed along the centerpath of a high voltage mercury-arc lamp equipment arranged with the lamps on the top, both sides and bottom for a period of about 4 seconds. Thus, by the ultraviolet irradiation, a polymer coating about 20μ thick was formed, which had a three dimensional network structure formed by the polymerization and cross-linking of the unsaturated polyester in the polymerizable solution spray coated on the outer wall surface of the container.

EXAMPLE 2

A polymerizable solution was prepared by using an acryl-epoxy resin as a prepolymer and mixing 0.2% by weight of benzoin methyl ether as a photosensitizer and 5 parts by weight of trimethylolpropane trimethacrylate based on 100 parts by weight of the above prepolymer. The polymerizable solution was spray-coated onto the outer wall surface of the non treated container produced as in Example 1 using the hot melt airless spray equipment as used in Example 1. The temperature of the polymerizable solution was 50° C. The solution was applied at a rate of 20 g per square meters of the surface of the container. Each container the outer wall surface of which had been coated with the polymerizable solution was immediately put into the ultraviolet irradiation oven of the same type as in Example 1 and subjected to ultraviolet irradiation for about 4 seconds. Thus, a polymer film about 20μ thick was formed on the outer wall surface of each paper container.

The polymer film coated outer wall surface of the paper containers produced in Examples 1 and 2 in superior in smoothness to that on conventional containers.

EXAMPLE 3

The paper containers produced by the procedures in Examples 1 and 2 and having the polymer film on the wall surface were tested for water resistance as follows: for blank test, a test piece of 38 mm long and 70 mm broad was cut from a given test paper and for water resistance tests another test piece measuring about 10 mm more both in length and breadth than the above test piece for blank test was cut from the same test paper. Thus, a total of four sample pieces was taken from each test piece. Double side polylaminated paper sheets were prepared. The number and size of the polylaminated paper sheets were the same as the test piece for water resistance test. The sample pieces thus obtained were overlapped with the double side polylaminated paper thus obtained with the surface to be tested out. The reason for this was to prevent vapor and moisture coming through the other surface during the "stiffness" test. In order to block the water penetration through the cut edge of the paper, a wax mixture was coated around the cut edge of the double ply sample pieces.

Then, absorbent cotton or the like was spread in a wide shallow container such as a vat and the cotton was soaked with water. The test pieces were placed on the absorbent cotton with the coated surfaces down and allowed to stand for about 72 hours, during which water was occasionally supplied to avoid depletion of the water. After 72 hours, each sample piece was removed, cut into a predetermined size and tested for stiffness on a Taber stiffness tester. At the same time, stiffness of the sample pieces for blank tests was measured to calculate the decrease in stiffness, thus percent decrease in stiffness was obtained. The Taber stiffness tester used was one that was specified in JIS-P-8125. The results are summarized in Table 1 below.

Table 1

| | Stiffness before test | | Stiffness after test | | Percent decrease |
|---|---|---|---|---|---|
| Test Piece | Length | Breadth | Length | Breadth | (%) |
| Example 1 | 90 | 50 | 80 | 42 | 12.8 |
| Example 2 | 88 | 45 | 80 | 40 | 9.7 |
| Uncoated piece | 55 | 30 | 10 | 4.5 | 82.9 |
| Control* | 60 | 30 | 50 | 25 | 16 |

*As control, paper laminated with polyethylene of about 20μ in thickness was used.

EXAMPLE 4

Paper cups were fabricated from a paper sheet using a conventional high-speed cup making machine. The so-fabricated cup was fixed on a holder which was then rotated at 1800 rpm. Using the same hot-melt airless spray equipment as used in Example 1 above, a polymerizable solution containing the prepolymer and photosensitizer indicated in Table 2 below was heated until the solution had a viscosity of 100 centipoises. The solution was then sprayed on the inner wall surfaces of the cup for a period of 0.1 second at a primary pressure of from 4 to 5 $Kg/cm^2$ while the holder was rotating. Upon completion of spraying, the rotation of the holder was stopped and the coated cup was passed through an irradiation tunnel at a conveyor speed of 10 m/min to cure the prepolymer in the solution with exposure to ultraviolet light.

Thereafter, the cup having the cured film on its inner wall surfaces was fixed on another holder, which was rotated at 1800 rpm. In the same manner as mentioned above, the polymerizable solution was sprayed in a moment to the outer wall surfaces of the cup using the hot-melt airless spray used above. The coated cup was passed through the irradiation tunnel at a conveyor speed of 10 m/min to cure the prepolymer in the solution.

Various capabilities of the so-formed cups having the cured films on their inner and outer wall surfaces were evaluated. Methods which were used for evaluation are as follows:

(A) Water resistance: each of the formed cups was dipped in water at a temperature of 25° C. for a period of 240 hours and checked for a change in the film (e.g. softening, cracking, blister, peeling and yellowing);

(B) Resistance to hot water: each of the formed cups was dipped in hot water having a temperature of 90° C. for a period of 2 hours and checked for a change in the film;

(C) Resistance to oil: the formed cups were filled with salad oil heated to a temperature of 60° C. and checked for a change in the film;

(D) Resistance to acids: the formed cups were filled with 0.5% aqueous citric acid solution heated to a temperature of 90° C. After standing for a period of 24 hours, they were checked for a change in the film;

(E) Sealing of inner edge of side seam portion: the formed cups were filled with hot water at a temperature of 60° C. and let stand for a period of 24 hours. While repeating the cycle of filling and standing, they were checked for water leaks through the inner edge forming a side seam extending in an axial direction along the cup side wall.

In this evaluation test, paper cups having an inner uncoated edge at the side seam and which were fabricated from a paper stock which was provided on both sides thereof with polyethylene film heat and pressure bonded thereto and paper cups which were coated on the entire wall surfaces with wax were used as controls 1 and 2, respectively.

The test results are shown in Table 2.

As clearly indicated in the Table, the cups manufactured in accordance with the present invention have higher capabilities than the cups made according to the prior art.

Table 2

| Exp. No. | Type of resin | Photo-sensitizer | Amount of photosensi-tizer added (wt. %) | Thickness of resulting cured film (average) (μ) | A | B | C | D | E |
|---|---|---|---|---|---|---|---|---|---|
| I | polyester (A) | benzophenone | 1 | 20 | no change | no change | no change | no change | no change |
| II | polyester (A) | benzophenone | 2 | 20 | no change | no change | no change | no change | no change |
| III | polyester (B) | benzophenone | 1 | 20 | no change | no chasnge | no change | no change | no change |
| IV | polyester (B) | benzoin ethyl ether | 1 | 20 | no change | no change | no change | no change | no change |
| V | acryl (A) | benzoin ethyl ether | 0.2 | 20 | no change | no change | no change | no change | no change |
| VI | acryl (A) | benzoin ethyl ether | 0.5 | 20 | no change | no change | no change | no change | no change |
| VII | acryl (A) | benzoin ethyl ether | 1 | 20 | no change | no change | no change | no change | no change |
| VIII | acryl (A) | benzoin ethyl ether | 2 | 20 | no change | no change | no change | no change | no change |
| IX | acryl (B) | benzoin ethyl ether | 1 | 20 | no change | no change | no change | no change | no change |
| X | acryl (B) | benzoin ethyl ether | 1 | 40 | no change | no change | no change | no change | no change |
| control 1 | — | — | — | — | swollen and softened | no change | leak | penetrating through the inner edge of side seam | leak |
| control 2 | — | — | — | — | no change | wax fused | swollen | waxfused | leak |

While certain representative embodiments and details have been shown for the purpose of illustrating the invention, it will be apparent to those having skill in this art various changes and modifications may be made therein without departing from the spirit or scope of the invention.

What is claimed is:

1. A process for making a paper container having high impermeability to liquid comprising making a paper container, spray coating a polymerizable solution containing at least a prepolymer and a photosensitizer onto the wall surface of said container, irradiating the coated surface of said container with ultraviolet light from all directions to effect the polymerization of the prepolymer contained in the polymerizable solution, thereby forming a liquid impermeable coating on the wall surface of the paper container, characterized in that said spray coating is conducted by hot-melt airless spraying; said polymerizable solution has a viscosity of at least 20 poises at ambient temperature and the viscosity of the solution is lowered to below 100 centipoises by heating; and fine particles resulting from atomizing the polymerizable solution of such lower viscosity by means of the hot-melt airless spraying are cooled by dissipation of heat into air, whereby the viscosity of the polymerizable solution returns to the initial high level when the particles of the solution have reached the paper surface.

2. A process according to claim 1 wherein about 0.05–5 parts by weight of the photosensitizer is blended with 100 parts by weight of the prepolymer in said polymerizable solution.

3. A process according to claim 1 wherein said polymerizable solution is sprayed onto both inner and outer wall surface of the container.

4. A process according to claim 1 wherein said polymerizable solution is sprayed onto either inner or outer wall surface of the container.

* * * * *